US012546118B2

(12) United States Patent
O'Neill

(10) Patent No.: US 12,546,118 B2
(45) Date of Patent: Feb. 10, 2026

(54) SYSTEM FOR ATTACHING PANELS TO A WALL

(71) Applicant: COMPTOIR DU BATIMENT NV, Kapelle-op-den-Bos (BE)

(72) Inventor: Bobby O'Neill, Glenmore (IE)

(73) Assignee: COMPTOIR DU BATIMENT NV, Kapelle-op-den-Bos (BE)

( * ) Notice: Subject to any disclaimer, the term of this patent is extended or adjusted under 35 U.S.C. 154(b) by 213 days.

(21) Appl. No.: 18/289,435

(22) PCT Filed: Apr. 27, 2022

(86) PCT No.: PCT/EP2022/061144

§ 371 (c)(1),
(2) Date: Nov. 3, 2023

(87) PCT Pub. No.: WO2022/233657

PCT Pub. Date: Nov. 10, 2022

(65) Prior Publication Data

US 2024/0254775 A1 Aug. 1, 2024

(30) Foreign Application Priority Data

May 7, 2021 (EP) ..... 21172747

(51) Int. Cl.
*E04F 13/08* (2006.01)
*E04F 13/14* (2006.01)

(52) U.S. Cl.
CPC ..... *E04F 13/0819* (2013.01); *E04F 13/14* (2013.01)

(58) Field of Classification Search
CPC ..... E04F 13/072; E04F 13/075; E04F 13/08; E04F 13/0801; E04F 13/0803;
(Continued)

(56) References Cited

U.S. PATENT DOCUMENTS 4,641,469 A * 2/1987 Wood ..... E04C 2/384 52/480
5,720,571 A * 2/1998 Frobosilo ..... E04B 2/96 403/231

(Continued)

FOREIGN PATENT DOCUMENTS

CN 105888179 A 8/2016
CN 113202250 A * 8/2021 ..... E04F 13/0819

(Continued)

*Primary Examiner* — Kyle J. Walraed-Sullivan
(74) *Attorney, Agent, or Firm* — Dilworth & Barrese, LLP; Michael J. Musella

(57) ABSTRACT

The invention is related to an attachment system comprising one or more panels provided with pairs of mutually parallel grooves through the back surface of the panels, a plurality of support profiles and a plurality of support brackets. The support profiles comprise a portion having an L-shaped section comprising a first leg portion and a second leg portion, so that the support profiles may be attached vertically to a wall with the second leg portion oriented at a distance from the wall and parallel thereto. The support brackets are formed of a first and second bracket profile configured to be assembled by inserting respective leg portions of the bracket profiles into the grooves, and securing wall portions of the bracket profiles to each other, thereby assembling the bracket and simultaneously clamping the bracket in said grooves.

13 Claims, 6 Drawing Sheets

(58) Field of Classification Search
CPC ..... E04F 13/0805; E04F 13/0807; E04F 13/0808; E04F 13/081; E04F 13/0814; E04F 13/0816; E04F 13/0835; E04F 13/0853; E04F 13/0855; E04F 13/148; E04F 13/23; E04F 13/24; E04F 13/25; E04F 13/28
See application file for complete search history.

(56) References Cited

U.S. PATENT DOCUMENTS 5,846,018 A * 12/1998 Frobosilo ..... F16B 5/0225 403/231
6,892,507 B1 * 5/2005 Pease ..... E04B 1/80 52/407.3
11,352,787 B2 * 6/2022 Amend ..... E04B 2/8647
2002/0056237 A1 * 5/2002 Price ..... E04F 13/0803 52/779
2003/0188497 A1 * 10/2003 Price ..... E04F 13/0803 52/169.12
2005/0005557 A1 * 1/2005 Bartman ..... E04F 13/0814 52/582.1
2008/0216444 A1 * 9/2008 Loyd ..... E04F 13/0826 52/742.16
2010/0236173 A1 * 9/2010 Pacha ..... B32B 17/06 52/592.1
2015/0068147 A1 * 3/2015 Huff ..... E04B 1/4178 52/506.05
2015/0308098 A1 * 10/2015 Tessadori ..... E04B 2/7411 52/698
2017/0002572 A1 * 1/2017 Wagner ..... E04F 13/0821
2017/0130464 A1 * 5/2017 Gleeson ..... E04F 13/0846

FOREIGN PATENT DOCUMENTS

EP 0547208 A1 12/1995
EP 1764456 A2 * 3/2007 ..... E04F 13/0808
EP 3020884 A1 * 5/2016 ..... E04F 13/142
KR 100751487 B1 8/2007
WO WO-2017201578 A1 * 11/2017 ..... E04F 13/0821

* cited by examiner

SYSTEM FOR ATTACHING PANELS TO A WALL

FIELD OF THE INVENTION

The present invention is related to the installation of panels on a wall, such as panels having a decorative function and mounted on the exterior surface of buildings.

STATE OF THE ART

Such decorative panels are often produced from fibre cement, and may be provided with a textured front surface for decorative purposes and a smooth back surface. The panels are mounted on an exterior wall with the requirement that no or very limited traces are observable of the attachment means applied to attach the panels. Attachment systems in use today include systems wherein hangers are fixed to the back surface of a panel, allowing the panel to be mounted on a framework of vertical and horizontal support profiles (also referred to as rails) mounted on the wall. While these systems are effective and show no outward trace of the attachment means, the use of vertical and horizontal rails represents an important material cost and increases the complexity of the installation procedure. The hangers are attached to the back of the panel by bolt connections or by clamping the hangers into horizontal grooves processed in the back surface of the panel. However, this makes the re-use of a panel difficult or impossible, as it may require drilling additional holes or processing additional grooves into the back of the panel. The hangers also represent fixation points which do not allow for expansion of the panel in the height direction, as a consequence of important temperature changes for example. This may cause excessive stress build-up in the panel, possibly leading to crack formation.

Some systems use only horizontal support profiles directly fixed to the wall, but this requires very accurate attachment of these profiles to the wall, which can easily lead to incorrect installations. Also, using only horizontal rails may restrict the dimensions of the cavity behind the panels, leading to problems in terms of the required airflow in such cavities.

SUMMARY OF THE INVENTION

The invention aims to provide solutions to the above problems. This aim is achieved by an attachment system and an installation method as disclosed in the appended claims.

The invention is in particular related to an attachment system comprising one or more panels provided with pairs of mutually parallel grooves through the back surface of the panels while not going through the full thickness of the panel, the system further comprising a plurality of support profiles and a plurality of support brackets. The support profiles comprise at least a portion having an L-shaped section comprising a first leg portion and a second leg portion, so that the support profiles may be attached vertically to a wall with the second leg portion oriented at a (non-zero) distance from the wall and parallel thereto.

In accordance with the invention, the support brackets each comprise an assembly of a first and a second bracket profile, each including a leg portion for fixation into a groove and a wall portion extending away from the leg portion and, after assembly, from the panel. At least two of the brackets attached to a panel are provided with elongated portions configured to extend beyond the upper edge of the panel, enabling the fixation of these brackets and thereby of the panel to the vertical support profiles attached to the wall.

The invention is related also to a support bracket, a method of mounting a panel using an attachment system as described above, as well as a cladding system comprising the support bracket, one or more panels and optionally the support profiles.

The attachment system requires only vertical support profiles fixed to a wall and thereby represents an improvement over many existing systems in terms of material cost and installation complexity. The grooves are oriented vertically when the panels are installed on a wall, making the exact positioning of the brackets in the height direction of the panel less critical. The mounting of a panel is straightforward, as the correct horizontal position is automatically reached when the leg portions of the support profiles become inserted into the half-closed spaces of the brackets when the panel is shifted horizontally with respect to the vertical support profiles.

In one embodiment, at least two support brackets comprise an elongated planar portion configured to extend beyond the upper edge of the panel and overlap the second leg portion of the L-section of at least two respective support profiles, when the brackets are mounted on the panel and the panel has been moved horizontally. This embodiment enables to fix the at least two elongated portions to the second leg portion of the L-section of said at least two respective support profiles.

In one further implementation, only the support brackets mounted near the upper edge of the panel are fixed, for example by screw connections, to the support profiles, while the lower brackets are not secured to said profiles in the vertical direction while still maintaining the panel at a fixed distance from the wall. This means that the panel is free to expand and retract in the height direction so that stress build-up and cracking is avoided.

Preferably, the wall portion of the second bracket profile is shorter than the wall portion of the first bracket profile as seen in a first main extension direction of the bracket profiles being perpendicular to the back side of the panel. In other words, the two bracket profiles mutually differ as to their top portion. This has been found effective to create the said half-closed space and to facilitate an aperture so that the second leg-portion of the support profile can slide in. Moreover In one specific implementation the half-closed space is generated in that the transversal portion of the first bracket profile is a planar portion extending at an essentially right angle to the wall portion of the first bracket profile. Furthermore, the transversal portion of the second bracket profile comprises a first slanted planar portion extending at an obtuse angle with respect to the wall portion of the second bracket profile, and further a second planar portion that is essentially perpendicular to the wall portion of the second bracket profile, forming an acute angle with the slanted portion.

Preferably, the transversal planar portion of the first bracket profile and the second planar portion of the second bracket profile are at different height levels relative to a base plane corresponding to the back side of the panel after mounting the bracket thereto, so as to allow the second leg portion of the L-section of a support profile to slide between said planar portions, into said half-closed space.

In again a further implementation, the elongated planar portion of said at least two brackets is uniform with the transversal portion of the first bracket profile of said at least two brackets. Said elongated planar portion constitutes an extension of said transversal portion.

The grooves are preferably made significantly longer than the length of the brackets, providing much flexibility in terms of the positioning the brackets. This makes it also easier to re-use a panel as the re-positioning of brackets requires no additional processing of the panel.

The structure of the brackets allows for the brackets to be made sufficiently high so that the cavity behind the panels can be large enough to provide a required airflow.

The bracket profiles are preferably made by means of extrusion, and more preferably comprise a metal, so as to ensure sufficient strength. Aluminum is a preferred choice. However, it is not excluded that use is made of composites, such as matrix materials reinforced with particles and/or fibers. Alternatively manufacturing techniques such as insert molding, transfer molding and 3D-printing are not excluded.

Any of the embodiments that are discussed hereinabove and/or hereinafter and/or defined in the dependent claims in relation to one aspect of the invention, such as the attachment system, are also applicable and deemed disclosed to the other aspects of the invention, such as the bracket, the method and the cladding systems.

BRIEF DESCRIPTION OF THE FIGURES

The figures illustrate exemplary embodiments only and are not limiting the scope of the invention. Equal reference numerals in different figures refer to equal or corresponding parts.

DETAILED DESCRIPTION OF PREFERRED EMBODIMENTS OF THE INVENTION

Figure 1:
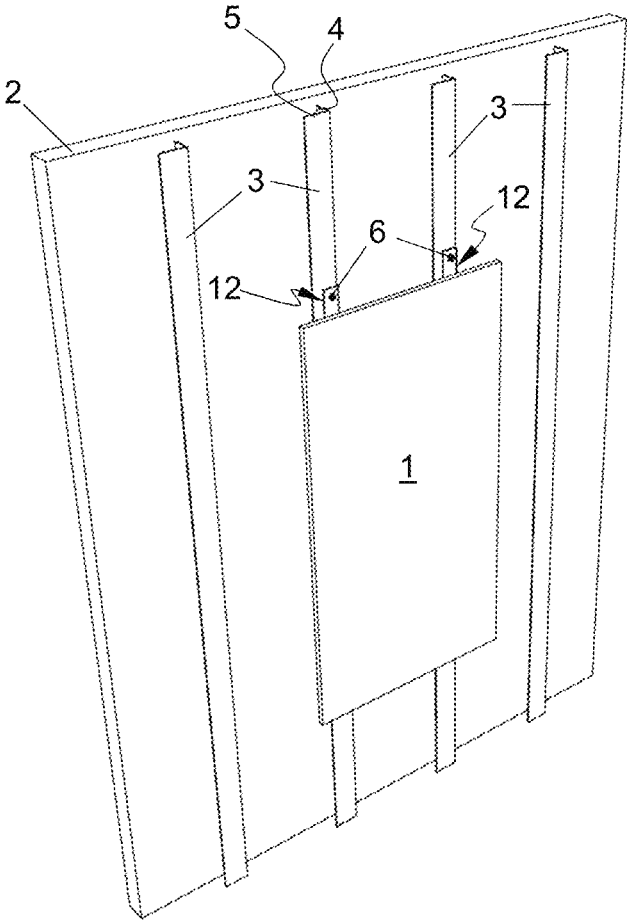
FIG. 1 shows the outer appearance of a wall provided with a panel attached by a system according to an embodiment of the invention.

FIG. 1 shows a single panel 1 mounted on a vertical wall 2, in accordance with an embodiment of the invention. Only one panel is shown in order to illustrate the invention, but it is to be understood that in most cases the wall is to be fully covered by multiple panels, with a small clearance between adjacent panels.

As seen in FIG. 1, the attachment system of the illustrated embodiment of the invention comprises, apart from the panel 1, a plurality of L-sectioned support profiles 3 which are mounted vertically on the wall 2. The way in which the L-profiles 3 are fixed to the wall is not shown, but this may be done in any way known in the art, for example by attaching the L-profiles to anchors fixed to the wall. Regardless of how the L-profiles are mounted, the cross-section of each of these profiles 3 comprises a first leg portion 4 that is essentially perpendicular to the wall 2 and a second leg portion 5 positioned at a distance from the wall 2 and oriented essentially parallel thereto. Any support rails equivalent to an L-profile, in terms of comprising the first and second leg portions 4 and 5 can be used, for instance T-profiles or U-profiles with one of the upstanding legs of the 'U' fixed to the wall 2. What counts is that an 'L-shaped section' of the support profiles 3 extends outward from the wall, said L-shaped section comprising the leg portions 4 and 5 oriented as described above. The support profiles 3 may be profiles that are already known today for use as vertical or horizontal support rails, i.e. no dedicated support profile design is required. The length of the leg portions 4 and 5 may be equal to each other or slightly different, as is the case in the enclosed drawings. As seen in FIG. 1, the panel 1 is attached to the second leg portion 5 of two adjacent profiles 3 by two connections 6, preferably screw connections.

Figure 2:
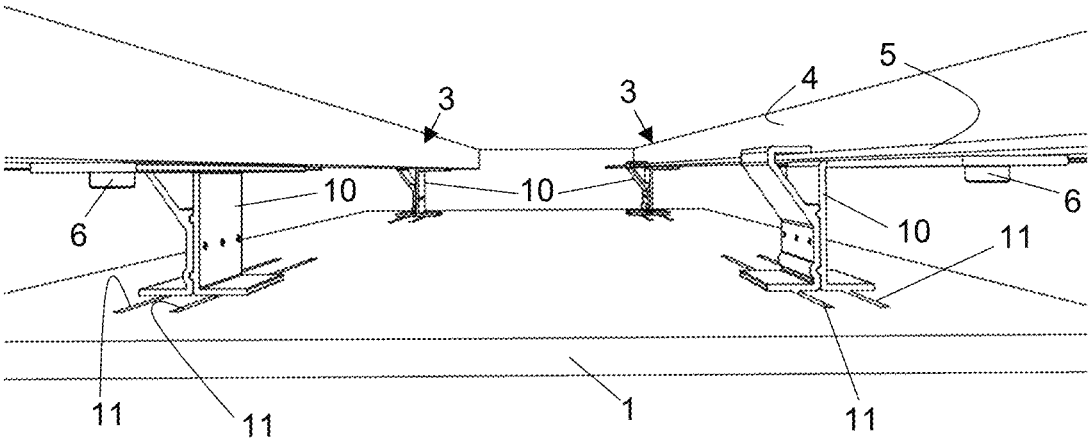
FIG. 2 shows the main components of the system applied to attach the panel shown in FIG. 1.

FIG. 2 is a view from the top, revealing the additional attachment means hidden behind the panel 1. It is seen that four support brackets 10 are attached to the back surface of the panel 1. Each bracket 10 is mounted into a pair of mutually parallel grooves 11, and the brackets are coupled to the second leg portion 5 of the support profiles 3, in a manner that will be detailed further in this description. To explain how the brackets 10 may be shaped and assembled, in accordance with one specific embodiment of the invention, reference is made to FIGS. 3 to 5. Nevertheless, the provision of a bracket comprising at least two bracket profiles each having a leg portion extending into a groove and with a wall portion extending away therefrom is known per se. KR100751487 for instance discloses in FIGS. 1 and 2 a system with grooves including oblique angles relative to the back side of the panel. The bracket profiles include an essentially S-shaped bottom part, wherein the utmost end constitutes the leg portion, which includes a sharp angle relative to a base portion. The wall portion is continued from the base portion at an approximately right angle therewith. The two wall portions are mutually secured by means of a screw and bolt fixture.

Figure 3:
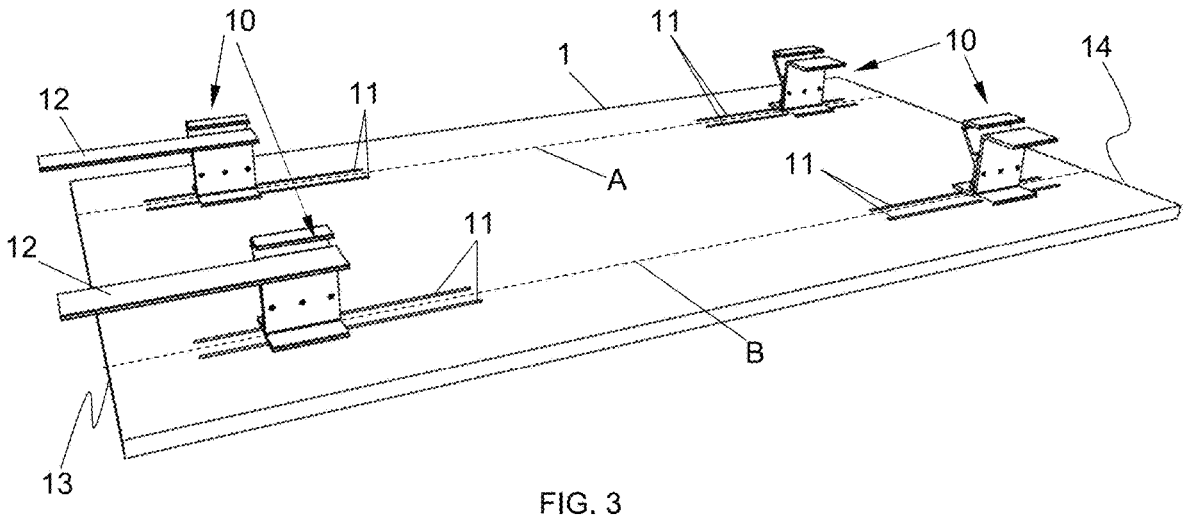
FIG. 3 shows the panel provided with support brackets, before mounting the panel to the wall.

FIG. 3 shows the panel 1 with the four brackets 10 attached thereto, before the panel is mounted to the wall. The panel 1 may be a fibre cement panel having a thickness of about 8 mm for example, and more generally in the range of 5-20 mm, although the invention is applicable to panels of all sizes, thicknesses and materials. In the particular embodiment shown, it is seen that four pairs of mutually parallel grooves 11 have been processed into the back of the panel 1. In general, a minimum of two pairs of mutually parallel grooves can be used depending on the size of the panel and engineering design calculations. In an 8-mm panel, the depth of the grooves 11 is preferably about 5 to 6 mm deep. The grooves have parallel side walls extending essentially perpendicularly to the back surface of the panel 1. The length of the grooves 11 is sufficient for receiving the brackets 10 therein, preferably exceeding the length of the brackets to a considerable degree, so that some flexibility is provided for the placement of the brackets 10 in the length direction of the grooves 11. In the embodiment shown, the pairs of grooves 11 are aligned along two lines A and B which will be oriented vertically when the panel 1 is mounted to the wall. The two brackets mounted close to the upper edge 13 of the panel comprise elongated plate portions 12 which extend beyond said upper edge 13. The extending ends of these plate portions 12 are visible in FIG. 1. Through these ends, the connections 6 are applied for attaching the panel 1 to the support profiles 3. Near the lower edge 14 of the panel, two brackets 10 are mounted which are not provided with the elongated portion 12.

Figure 4A:
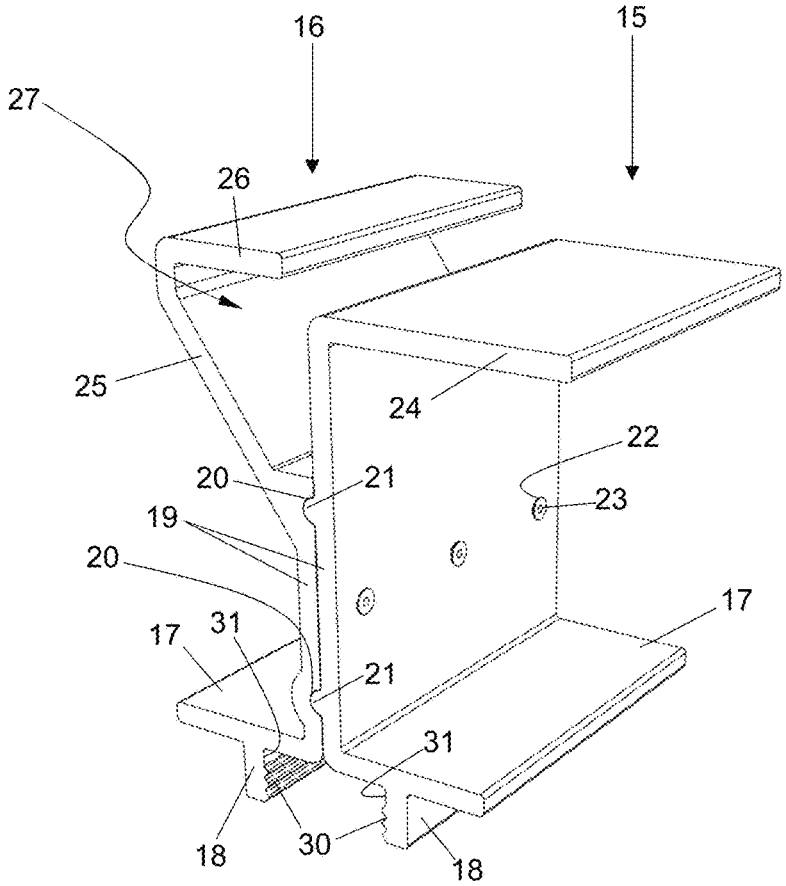
FIGS. 4*a* and 4*b* represent a 3D view and a section view of one of the support brackets.
Figure 4B:
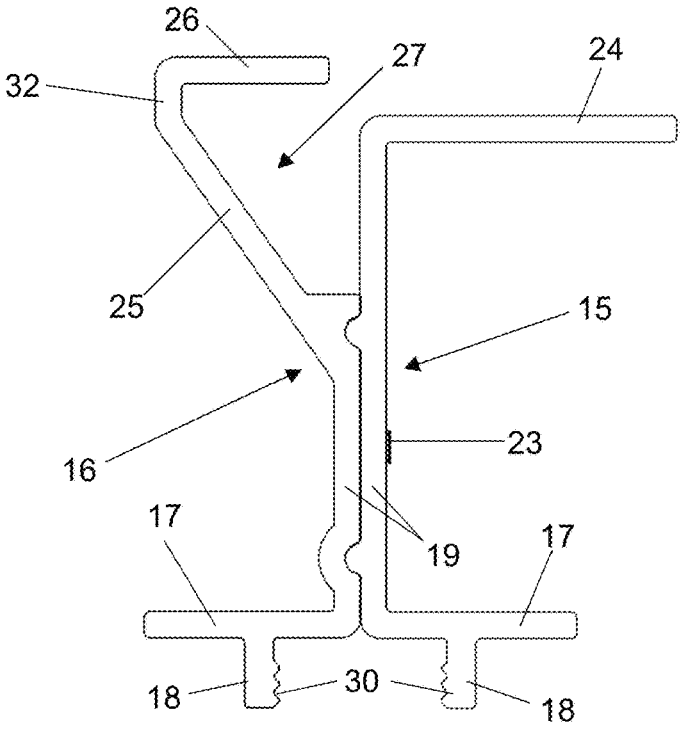

Before explaining how the panel 1 is mounted to the wall, the brackets 10 are described in more detail as well as the manner in which the brackets are assembled. FIG. 4*a* shows a detailed view of one of the brackets 10 mounted near the lower edge 14 of the panel 1. The bracket consists of an assembly of two bracket profiles 15 and 16, which may be formed of extruded aluminium for example. Each bracket profile 15, 16 comprises a number of plate-shaped sub-portions, starting with a base portion 17, a leg portion 18 extending downward from about the middle of the base portion 17, and a wall portion 19 extending upward from the edge of the base portion 17. The wall portions 19 are provided with respective grooves 20 and ridges 21 which fit together when the wall portions 19 are placed against each other, with the base portions 17 at the same level. The wall portions 19 further comprise facing holes 22 through which connectors 23 are inserted which secure the bracket profiles 15, 16 together. These connectors may be rivets 23 as shown, or they may be bolt connections, screw connections or any other suitable connector type. As discussed before, this base structure of the bracket 10 is merely a preferred embodiment of the present invention. Alternative base structures may be applied in combination with the inventive concept of creating a half-closed space into which the second leg portion of an L-shaped section of the support profile may be inserted by sliding.

The bracket profiles 15, 16 further comprise transversal portions at the top of the wall portions 19 (i.e. at the side opposite the base portions 17). The first bracket profile 15 comprises a transversal portion 24 that is a rectangular plate element oriented essentially perpendicularly to the wall portion 19 of the first bracket profile 15. The second bracket profile 16 comprises a transversal portion comprising a first plate portion 25 extending at an obtuse angle from the wall portion 19 of the second bracket profile 16, the latter wall portion being shorter (as seen in the direction perpendicular to the base portion 17) than the wall portion of the first bracket profile 15, and at the top of the angled portion 25 a planar portion 26 that is essentially perpendicular to the wall portions 19 of both bracket profiles 15 and 16 (i.e. essentially parallel to portion 24) and that forms an acute angle with the angled portion 25. The latter planar portion 26 of the second bracket profile 16 is located at a higher level from the base portions 17, compared to the transversal portion 24 of the first bracket profile 15 so that the transversal portions define a half-closed space 27 into which a planar plate element can be slidably inserted. The term 'half-closed' is applicable to the cross-section of the assembled bracket 10, as illustrated in the section view of FIG. 4*b*: the space 27 is open on the side of the first bracket profile 15, and closed on the side of the second bracket profile 16. As seen in the drawing, the space 27 is preferably closed on said latter side by a short wall portion 32 that interconnects the portions 25 and 26.

The width and height (in the direction perpendicular to the base portion 17) of the leg portions 18 are matched to the width and depth of the grooves 11 so that the leg portions 18 can be inserted manually in said grooves, preferably being able to be inserted fully in the grooves 11, so that the base portions 17 are lying against the back surface of the panel 1.

In the embodiment shown, the leg portions 18 of the profiles are provided with gripping teeth 30 extending along the full length of the leg portions 18, the teeth 30 being present on the mutually facing sidewalls of the leg portions 18. Still in the embodiment shown, said mutually facing sidewalls comprise a first portion 31 near the base portion 17 of the respective profiles, the first portion having no teeth produced thereon, followed by the three teeth 30. This way of producing the teeth 30 has been proven optimal in the case of a fibre-cement panel and represents a preferred embodiment of the teeth 30 on the leg portions 18. For a panel having a thickness of about 8 mm, it is preferable to provide three teeth as shown, wherein the width of each tooth is of the order of 1 mm. For thicker panels, the number of teeth having this same width may be increased. The invention is however not limited to this embodiment, and includes embodiments involving other configurations and dimensions of teeth or equivalent gripping aids, as well as leg portions that are not provided with gripping aids, and which are clamped mainly by friction between the leg portions 18 and the sidewalls of the grooves 11.

Figure 5A:
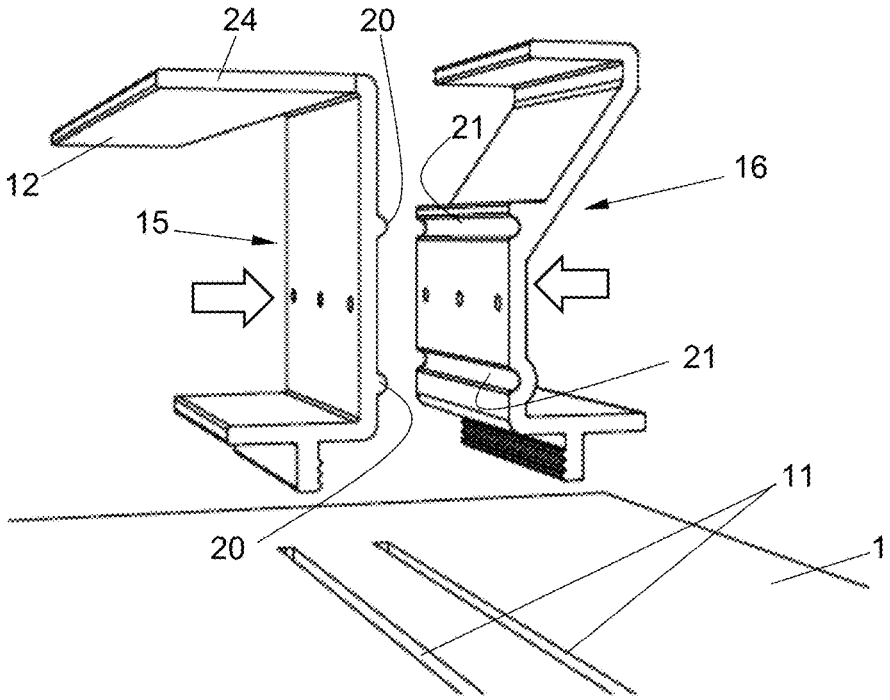
FIG. 5 illustrates the steps applied for mounting a bracket to the back surface of the panel.
Figure 5B:
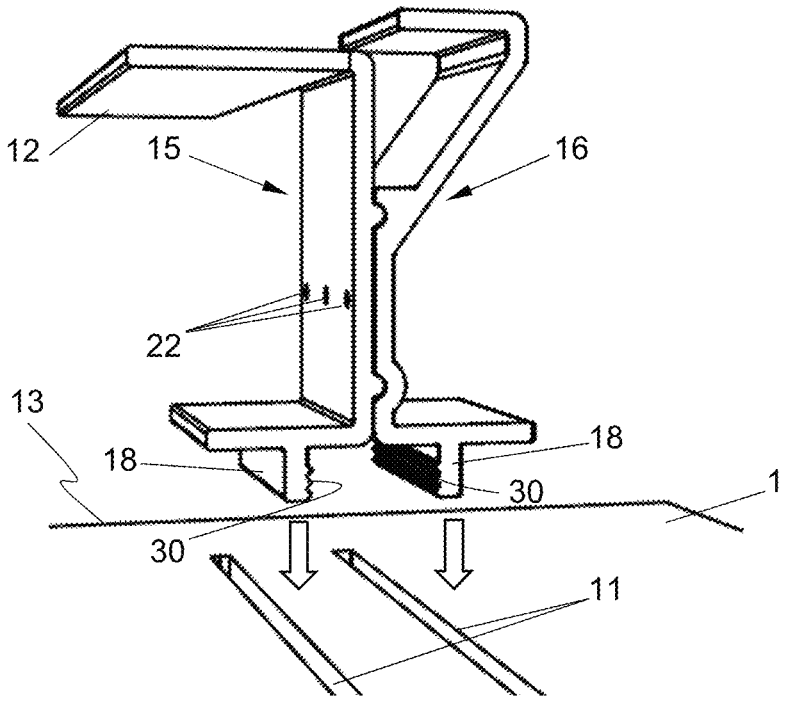
Figure 5C:
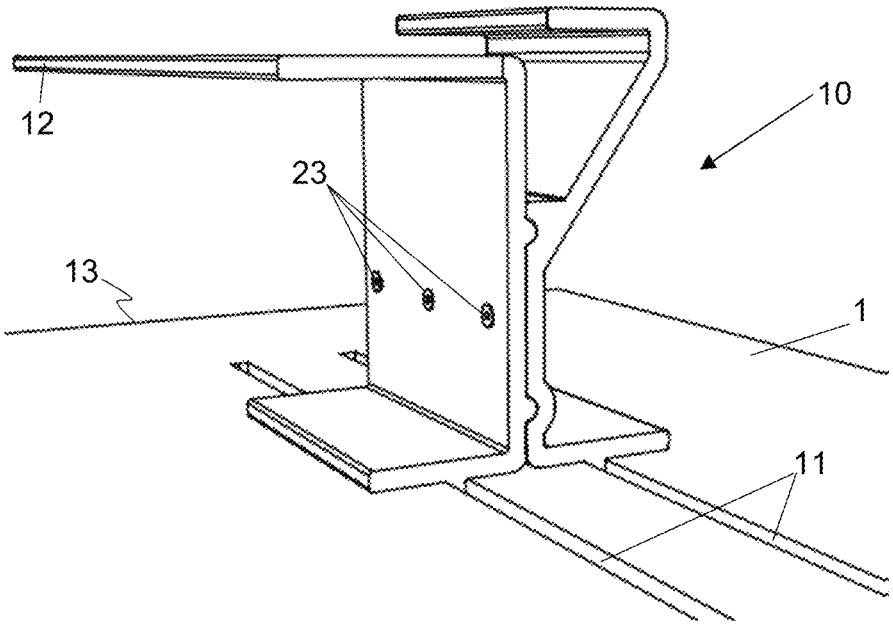

The assembly of the brackets 10 is illustrated in FIGS. 5*a* to 5*c*, illustrating the assembly of one of the brackets mounted close to the upper edge 13 of the panel, and comprising the elongated portion 12. In this embodiment, the elongated portion 12 is a uniform extension of the transversal portion 24 of the first bracket profile 15. According to other embodiments, the elongated portion 12 could be a separate piece attached to the bracket before or after its assembly.

As illustrated in FIGS. 5*a* and 5*b* and in accordance with a preferred embodiment of the present invention, the bracket profiles 15 and 16 are placed together manually, by placing the ridges 21 of the first bracket profile 15 into the corresponding grooves 20 of the second bracket profile 16, and with the holes 22 of the two bracket profiles facing each other. The leg portions 18 of the bracket profiles 15 and 16 are then inserted in the grooves 11 of one of the groove pairs, as illustrated in FIG. 5*b*.

When the bracket profiles 15 and 16 are correctly positioned in the grooves 11, they are secured to each other by inserting rivets 23 into the matching holes 22, thereby pulling the profiles towards each other and clamping the leg portions 18 in the grooves 11, as shown in FIG. 5*c*. The teeth 30 are pulled against the walls of the grooves 11, ensuring thereby a sufficient clamping force. The bracket 10 may however be assembled also in different manner.

In one advantageous embodiment, the bracket profiles 15, 16 are placed in such a way that part of the elongated portion 12 extends beyond the upper edge 13 of the panel 1 the length direction of the grooves 11 (as shown in FIG. 3). Possibly a positioning aid could be used in the form of a block or other object having the desired length of the extending portion, so that the block may be placed against the upper edge 13, thereby allowing to position the profiles correctly with respect to said upper edge. Alternatively, a marker could be produced on the elongated portion 12 itself, so that the marker can be aligned with the upper edge 13 for correctly positioning the profiles in the grooves 11.

When all the brackets 10 are assembled and thereby attached to the back surface of the panel 1, a panel as shown in FIG. 3 results, provided with four brackets 10. The mounting of the panel 1 to the wall 2 is illustrated in FIGS. 6 and 7.

Figure 6:
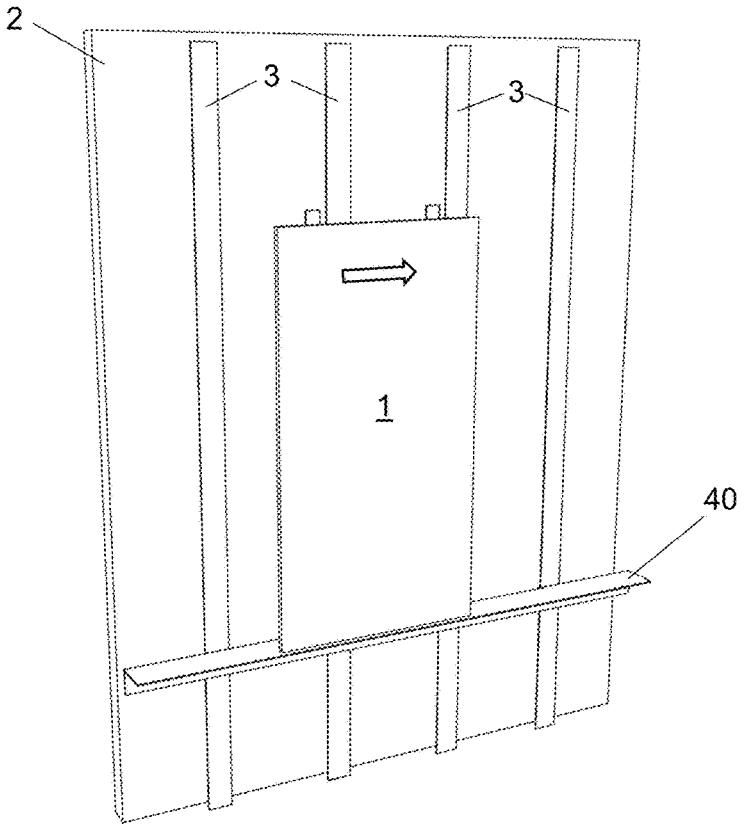
FIG. 6 illustrates how a panel may be moved to its mounting position by shifting the panel horizontally while being supported by a preliminary support.
Figure 7A:
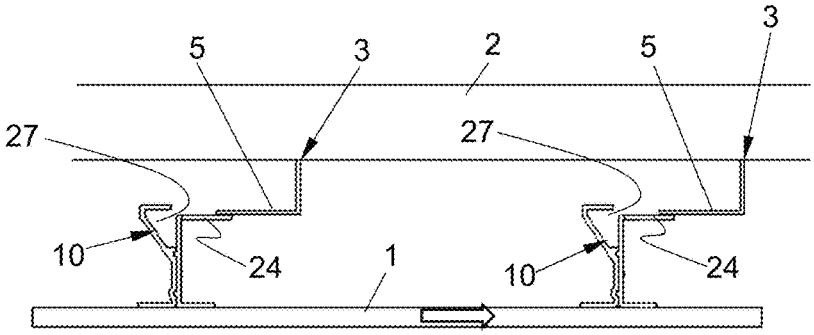
FIGS. 7*a* and 7*b* illustrate the horizontal shifting movement of the panel, as seen from above.

As shown in FIG. 6, an auxiliary profile 40 is preferably used. This auxiliary profile 40 may be an L-profile as shown, that is temporarily attached to the vertical support profiles 3, for example by manually attachable and removable clamps (not shown), and positioned horizontally, preferably with the aid of a spirit level, at the required position of the lower edge of the panel 1. The panel 1 is placed on the auxiliary profile 40 and shifted horizontally. This is illustrated in the top view shown in FIG. 7*a*.

Figure 7B:
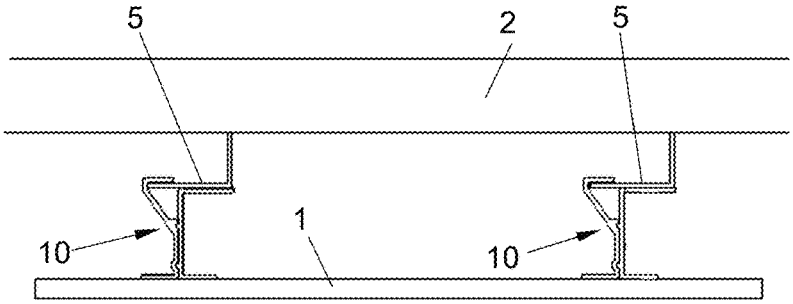

The transversal portions 24 of the brackets 10 are placed in contact with the second leg portions 5 of the support profiles 3, and then the panel is moved horizontally, until said leg portions 5 slide into the half-closed spaces 27 of the brackets 10, as illustrated in FIG. 7*b*. At this point, the panel is correctly positioned horizontally, and maintained at a fixed distance from the wall 2 at four locations by the brackets 10. At this point also, the elongated portions 12 of the brackets 10 overlap the second leg portions 5 of the support profiles 3.

The technician can then secure the panel 1 to the wall 2 by the connections 6 through said portions 12 and through said leg portions 5, as shown in FIG. 1. These connections 6 may be any suitable fastening means, such as self-drilling screws for attaching metal plate elements without pre-drilling. Nevertheless, pre-formed holes may be present in the elongated portions 12 of the brackets to enable the use of other types of fasteners. The attached panel is thereby suspended from the support profiles 3 at two positions only, along the upper edge of the panel, leaving the panel free to expand and contract in the height direction.

Figure 8A:
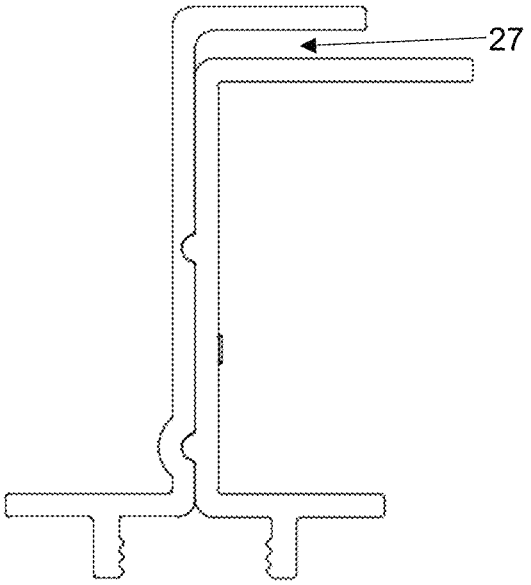
FIGS. 8*a* and 8*b* illustrate alternative shapes of a support bracket applicable in a system and method according to the invention.
Figure 8B:
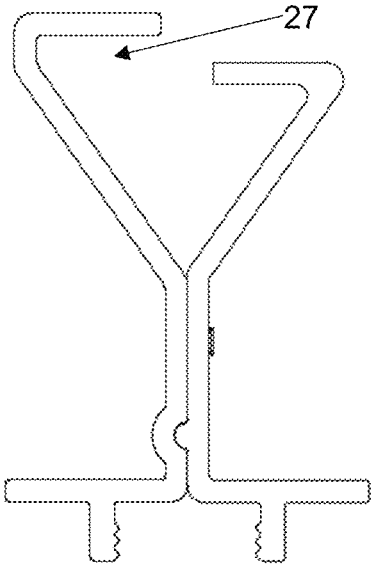

As indicated already in a number of instances, the invention is not limited to the embodiment shown in the drawings. The shape of the brackets may be different, within the boundaries of the characteristics included in the independent claims. For example, the transversal portions 24 and 25/32/26 of the bracket profiles 15 and 16 could have a different shape, while still allowing the second leg portion 5 of the support profiles to be inserted in the half-closed space 27 defined by said transversal portions. A few examples of such alternative shapes are shown in FIGS. 8*a* and 8*b*. In both drawings, the half-closed space 27 is indicated into which the second leg 5 of the support profiles 3 may be slidably inserted. Various other alternatives may be devised by the skilled person, all falling within the scope of the present invention.

The number of brackets 10 applied to a panel 1 may be different than four. More than four brackets may be required for attaching a large panel for example.

The panels 1 are preferably planar rectangular panels as shown, but they may include shapes other than rectangles, as well as panels with a certain curvature. Such panels may either be attached to similarly curved wall surfaces or the support brackets 10 may be adapted to the curvature of the panels, for example by orienting the leg portions 18 not perpendicularly to the base portions 17 but at an angle corresponding to the curvature of the panel at a given position.

The invention claimed is:

1. An attachment system for attaching panels (1) to a wall (2), wherein at least one of said panels (1) has a front surface, a back surface, an upper edge (13) and a lower edge (14), and is provided with multiple pairs of mutually parallel grooves (11) through the back surface of the panel, each pair of grooves being configured to be oriented in the vertical direction when the panel is mounted to the wall (2), the attachment system comprises:

at least two support profiles (3) configured to be fixed vertically to the wall and shaped so that an L-shaped section (4,5) of the support profiles, extends outward from the wall (2) when the at least two support profiles are fixed thereto, said L-shaped section comprising a first leg portion (4) and a second leg portion (5), with the first leg portion (4) oriented transversely with respect to the wall and the second leg portion (5) at a distance from the wall and essentially parallel thereto, and a plurality of support brackets (10) configured for fixation into the grooves, each support bracket comprising an assembly of a first and a second bracket profile (15, 16), each including a leg portion for fixation into a groove and a wall portion extending away from the leg portion and, after assembly, from the panel, and the first and second bracket profiles (15,16) each comprise at least one transversal portion (24; 25,26,32) at the top of the respective wall sections (19), the transversal portions being shaped to form a space (27) when the plurality of support brackets (10) are assembled, into which space the second leg portion (5) of the L-shaped section of a support profile (3) can be slidably inserted, thereby enabling the panel (1) provided with multiple assembled brackets (10) to be moved horizontally relative to the support profiles (3) until the second leg portion (5) of the L-shaped section of at least two support profiles slides into the spaces (27) of a plurality of brackets.

2. The attachment system as claimed in claim 1, wherein said at least two support brackets (10) comprise an elongated planar portion (12) configured to extend beyond the upper edge (13) of the panel (1) and overlap the second leg portion (5) of the L-shaped section of at least two respective support profiles (3), when the plurality of support brackets (10) are mounted on the panel (1) and the panel has been moved horizontally, thereby enabling to fix at least two elongated portions (12) to the second leg portion (5) of the L-shaped section of the at least two support profiles (3).

3. The attachment system according to claim 1, wherein the wall portion (19) of the second bracket profile (16) is shorter than the wall portion of the first bracket profile (15) as seen in a first main extension direction of the first and second bracket profiles (15, 16) being perpendicular to the back surface of the panel.

4. The attachment system as claimed in claim 1, wherein the transversal portion of the first bracket profile (15) is a planar portion (24) extending at an essentially right angle to the wall portion (19) of the first bracket profile (15), and the transversal portion of the second bracket profile (16) comprises a first slanted planar portion (25) extending at an obtuse angle with respect to the wall portion (19) of the second bracket profile (16), and further a second planar portion (26) essentially perpendicular to the wall portion (19) of the second bracket profile (16), forming an acute angle with the slanted portion (25), thereby forming said space (27).

5. The attachment system as claimed in claim 4, wherein the transversal portion (24) of the first bracket profile and the second planar portion (26) of the second bracket profile are at different height levels relative to a base plane corresponding to the back surface of the panel after mounting each support bracket thereto, to allow the second leg portion (5) of the L-shaped section of a support profile (3) to slide between said planar portions (24,26), into said space (27).

6. The attachment system according to claim 4, wherein an elongated planar portion (12) of said plurality of support brackets is uniform with the transversal portion (24) of the first bracket profile (15) of said plurality of support brackets, and forms an extension of said transversal portion (24).

7. The attachment system according to claim 1, wherein the each wall portions (19) of the first and second bracket profile (15,16) are provided with holes (22) configured to face each other when the first and second bracket profile are separately inserted respectively in the mutually parallel grooves (11) of a pair of grooves, enabling each wall portions (19) to be secured to each other through connectors (23) inserted through the facing holes (22), thereby simultaneously assembling each support bracket (10) and clamping thereof into the mutually parallel grooves (11).

8. The attachment system according to claim 1, wherein each of the first and second bracket profiles further comprises a base portion (17), and the leg portion (18) configured to be inserted in one of the mutually parallel grooves (11) of one of the mutually parallel grooves, extends outward from the base portion (17) in one direction, and the wall portion (19) extends outward from the base portion (17) in the opposite direction of the leg portion (18).

9. The attachment system according to claim 1, wherein the panels (1) are fibre cement panels.

10. The attachment system according to claim 1, wherein the first and second profiles (15,16) of the support brackets (10) are formed of extruded aluminium.

11. A method for mounting one or more panels (1) to a wall (2), wherein said one or more panels are provided with multiple pairs of mutually parallel grooves (11) through a back surface of the one or more panels, and said method comprises the steps of:

attaching a plurality of support profiles (3) vertically to the wall (2), so that an L-shaped section (4,5) of the support profiles extends outward from the wall, with a second leg portion (5) of a L-section at a distance from the wall and parallel thereto, mounting a plurality of support brackets (10) to said one or more panels, said mounting step comprises providing multiple pairs of first and second bracket profiles (15,16), inserting leg portions thereof into respective grooves of a pair of grooves and assembling the multiple pairs of mutually parallel grooves into the support bracket, and moving the one or more panels (1) sideways relative to the support profiles (3), until a second leg portion (5) of the L-section of at least two support profiles (3) slides into a space (27) of a plurality of the support brackets (10), with elongated portions (12) overlapping the second leg portion (5) of an L-section of the at least two support profiles (3).

12. The method as claimed in claim 11, wherein at least two brackets (10) comprises an elongated planar portion (12) and are assembled so that part of the elongated planar portion (12) extends beyond an upper edge (13) of the one or more panel (1), and the one or more panel (1) is secured to the wall by connecting extending parts of each elongated portions (12) to the second leg portion (5) of the L-section of said support profiles (3).

13. The method according to claim 11, wherein:

an auxiliary carrier profile (40) is temporarily attached to the support profiles (3) and oriented horizontally, the one or more panel (1) is placed on the auxiliary carrier profile (40) and moved sideways while being supported by the auxiliary carrier profile (40), and the auxiliary carrier profile (40) is removed after attaching the one or more panel (1).

* * * * *